US009905206B2

(12) United States Patent
Alexander

(10) Patent No.: US 9,905,206 B2
(45) Date of Patent: Feb. 27, 2018

(54) CAJON

(71) Applicant: Eric Jay Alexander, Orem, UT (US)

(72) Inventor: Eric Jay Alexander, Orem, UT (US)

( * ) Notice: Subject to any disclaimer, the term of this patent is extended or adjusted under 35 U.S.C. 154(b) by 0 days.

(21) Appl. No.: 14/645,236

(22) Filed: Mar. 11, 2015

(65) Prior Publication Data

US 2015/0262563 A1 Sep. 17, 2015

Related U.S. Application Data

(60) Provisional application No. 61/951,405, filed on Mar. 11, 2014.

(51) Int. Cl.
*G10D 13/02* (2006.01)

(52) U.S. Cl.
CPC ..... *G10D 13/028* (2013.01); *G10D 13/022* (2013.01); *G10D 13/025* (2013.01); *G10D 13/027* (2013.01)

(58) Field of Classification Search
CPC .. G10D 13/028; G10D 13/022; G10D 13/025; G10D 13/027; G10D 13/08
USPC ..... 84/414
See application file for complete search history.

(56) References Cited

U.S. PATENT DOCUMENTS

| | | | | |
|---|---|---|---|---|
| 6,909,040 | B1 * | 6/2005 | Fredrickson | G10D 13/02 84/411 R |
| 8,350,138 | B2 | 1/2013 | Schmader | |
| 2008/0020222 | A1 * | 1/2008 | Hiraku | B27D 1/08 428/541 |
| 2009/0013849 | A1 * | 1/2009 | Payerl | G10D 13/02 84/411 R |
| 2009/0019985 | A1 * | 1/2009 | Casanta | G10D 13/027 84/411 R |
| 2009/0254206 | A1 | 10/2009 | Snowdon et al. | |
| 2013/0068083 | A1 | 3/2013 | Eduardo | |

* cited by examiner

*Primary Examiner* — Jianchun Qin
(74) *Attorney, Agent, or Firm* — Kirton McConkie; Adam D. Stevens

(57) ABSTRACT

Cajones or cajon drums include a variety of improvements over existing cajones. Improvements include improved rigidity of sides other than a side containing a striking surface to prevent loss of volume, a vent hole located on a same side as the striking surface, the use of layers of maple to provide the striking surface, the use of added masses on the striking surface to modify the fundamental frequency of the striking surface, the use of a receptacle containing small metal (copper or silver) items to provide a snare effect, internal dimensions of the cajon chosen to match resonant frequencies of a selected style of music, and the use of damping materials in the cajones to modify the tone.

19 Claims, 5 Drawing Sheets

CAJON

CROSS-REFERENCE TO RELATED APPLICATIONS

This application claims the benefit of U.S. Provisional Application No. 61/951,405, filed Mar. 11, 2014.

BACKGROUND OF THE INVENTION

1. Field of the Invention

The present invention relates to percussion instruments, and more particularly to cajon drums or cajones.

2. Background and Related Art

A cajon is a six sided, box-shaped percussion instrument originally from Peru, played by slapping the front or rear faces (generally thin plywood) with the hands, fingers, or sometimes various implements such as brushes, mallets, or sticks. Many cajon builders use identical thickness layers on all six sides of the cajones, resulting in poor acoustical projection and many phase canceling properties. In other instances, sheets of wood are used for five sides of the box, and a thinner sheet of plywood is nailed on as the sixth side, and acts as the striking surface or head. A sound hole is typically cut on the back side opposite the head or tapa.

The top edges are often left unattached and can be slapped against the box. The player sits astride the box, tilting it at an angle while striking the head between his knees. The modern cajon may have rubber feet, and has several screws at the top for adjusting percussive timbre. Originally they would be only wooden boxes but now some versions may also have several stretched cords pressed against the tapa for a buzz like effect or tone. Guitar strings, rattles or drum snares may serve this purpose. They may also have bells on the inside near the cords. The percussionist can play the sides with the top of his palms and fingers for additional sounds. There are also tube cajones, which are played like a conga.

Existing cajones are generally simple devices not constructed according to any particular musical principles. Significant improvements are needed to provide better cajones.

BRIEF SUMMARY OF THE INVENTION

Implementation of the invention provides improved cajones. According to one implementation, a cajon includes a striking surface disposed on a first side of the cajon, wherein a top, bottom and any remaining sides of the cajon comprise rigid panels to prevent loss of volume or acoustical intensity from acoustical phase cancellation of the cajon through the top, bottom, and the remaining sides. Instead, percussion sounds are projected from the front panel singly with greater intensity and resonance. The first side may also include a vent hole. The cajon may also include a skeleton underlying and supporting selected portions of the striking surface.

According to another implementation, a cajon includes a striking surface disposed on a first side of the cajon and a vent hole disposed on the first side of the cajon.

According to another implementation, a cajon includes a striking surface comprising one or more thin layers of maple disposed on a first side of the cajon. Each layer of maple (or other type of wooden material if used instead of maple) may have a thickness of between approximately 1/32" and approximately 1/12". In one implementation, each layer of maple has a thickness of approximately 1/20". The resulting construction may have an average overall thickness of approximately 1/8" or less.

According to another implementation, a cajon includes a striking surface disposed on a first side of the cajon and a skeleton underlying and supporting selected portions of the striking surface. A material of the striking surface may be affixed to the skeleton. The skeleton may divide the striking surface into a plurality of striking areas having different fundamental tones.

According to another implementation, a cajon includes a striking surface disposed on a first side of the cajon and a mass affixed to a portion of the striking surface to increase the effective mass of the striking surface and to reduce a fundamental frequency of the striking surface. The mass may include a fastener passing through the striking surface and one or more weights affixed to the fastener. A solid molecular applied surface, such as a spayed-on polyester primer or polyurethane, is another method for adding mass to the vibratory/resonating surface.

According to another implementation, a cajon includes a striking surface disposed on a first side of the cajon, a receptacle contained within the cajon in a manner so as to be at least selectively in contact with an inner side of the striking surface, and a plurality of small metal items loosely contained within the receptacle so as to provide a snare effect when the striking surface is struck, the small metal items comprising a metal selected from the group consisting of copper and silver. The receptacle may be or include a bag formed of a flexible material.

According to another implementation, a cajon includes a top, a bottom, a first pair of opposed sides extending between the top and the bottom, and a second pair of opposed sides extending between the top and the bottom and further extending between the first pair of opposed sides, wherein internal dimensions between the top and the bottom, between the first pair of opposed sides, and between the second pair of opposed sides are selected based on resonant fundamental frequencies of selected tones from a selected style of music. One of the four sides of the cajon includes or forms a striking surface, and the internal dimension of the pair of sides including the striking surface is measured from an inner surface of the striking surface. The selected style of music may be a style selected from the group of a traditional twelve-pitch-per-octave western style, a pentatonic style, or some other style.

According to another implementation, a cajon includes a striking surface and a damping material disposed within the cajon to tune the cajon.

Implementations of the invention may provide multiple of the features disclosed herein in a variety of combinations. The scope of the claimed invention is not limited to any particular combination of features discussed herein, but should be ascertained by reference to the appended claims.

BRIEF DESCRIPTION OF THE SEVERAL VIEWS OF THE DRAWINGS

The objects and features of the present invention will become more fully apparent from the following description and appended claims, taken in conjunction with the accompanying drawings. Understanding that these drawings depict only typical embodiments of the invention and are, therefore, not to be considered limiting of its scope, the invention will be described and explained with additional specificity and detail through the use of the accompanying drawings in which:

DETAILED DESCRIPTION OF THE INVENTION

Figure 1:
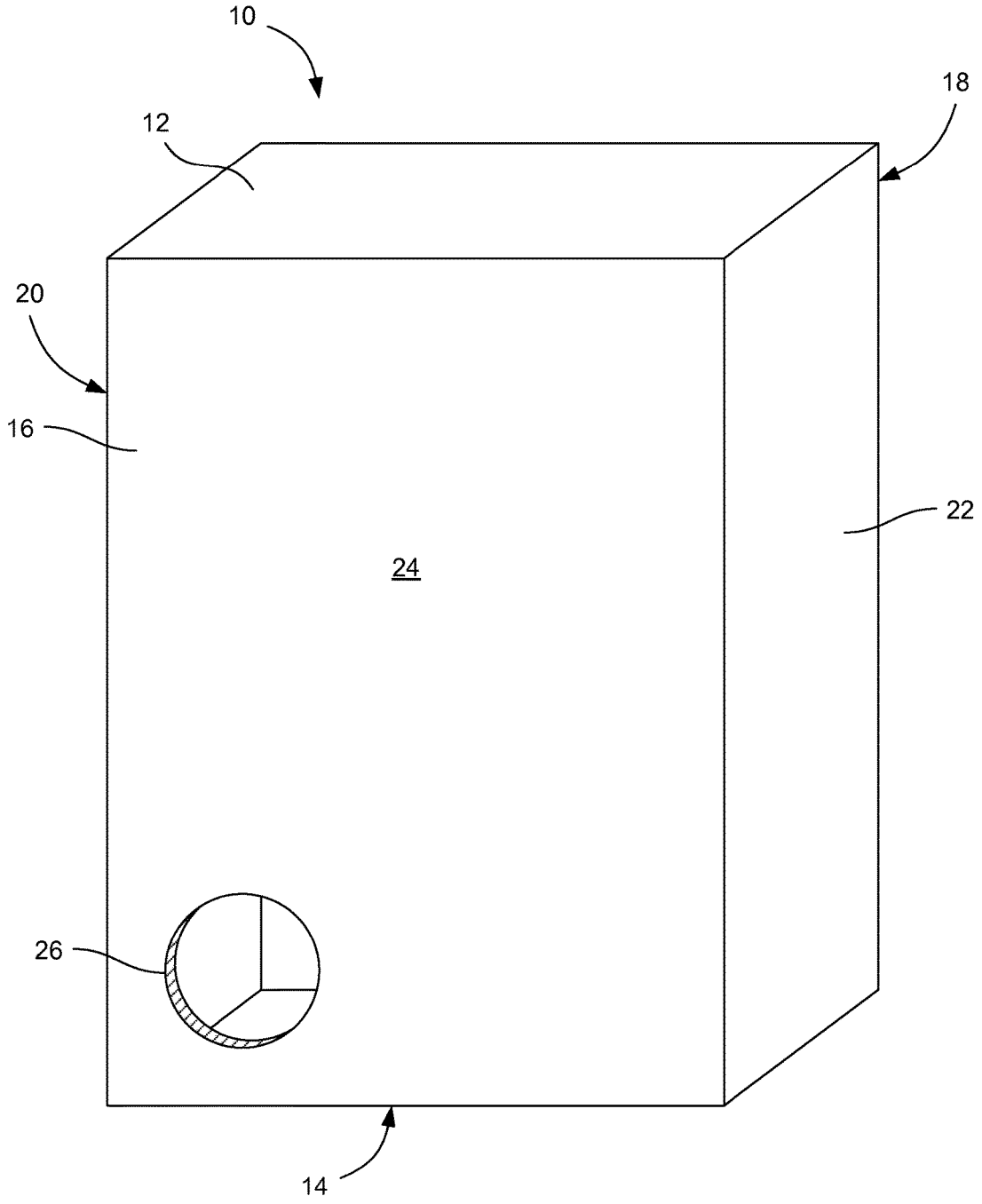
FIG. 1 shows a perspective view of an exemplary cajon.

A description of embodiments of the present invention will now be given with reference to the Figures. It is expected that the present invention may take many other forms and shapes, hence the following disclosure is intended to be illustrative and not limiting, and the scope of the invention should be determined by reference to the appended claims.

Embodiments of the invention provides improved cajones. According to exemplary embodiments, a cajon includes a striking surface disposed on a first side of the cajon, wherein a top, bottom and any remaining sides of the cajon comprise rigid panels to prevent loss of volume or acoustical intensity from acoustical phase cancellation of the cajon through the top, bottom, and the remaining sides. The result is that percussion sounds are projected from the front panel singly with greater intensity and resonance. The rigid panels may be formed of a variety of sufficiently rigid materials, such as ¾" medium density fiberboard (MDF). The first side of the cajon may also include a vent hole in the manner of a classic Helmholtz resonator. The cajon may also include a skeleton underlying and supporting selected portions of the striking surface. The skeleton may be used to divide the striking surface into areas having different resonant frequencies.

According to other exemplary embodiments, a cajon includes a striking surface disposed on a first side of the cajon and a vent hole disposed on the first side of the cajon. In other words, the vent hole is disposed on the same side of the cajon as is the striking surface.

According to other exemplary embodiments, a cajon includes a striking surface comprising one or more thin layers of maple or other wood material disposed on a first side of the cajon. Each layer of maple or other type of wood material used may have a thickness of between approximately 1/32" and approximately 1/12". The resulting construction may have an average overall thickness of approximately 1/8" or less. In some embodiments, each layer of maple has a thickness of approximately 1/20". In some embodiments, two layers of 1/20" maple are used for the striking surface.

According to other exemplary embodiments, a cajon includes a striking surface disposed on a first side of the cajon and a skeleton underlying and supporting selected portions of the striking surface. A material of the striking surface may be affixed to the skeleton. The skeleton may divide the striking surface into a plurality of striking areas having different fundamental tones. The skeleton may be formed of a material that is more rigid than the material used for the striking surface, such as, for example, one or more materials that may also be used for other sides of the cajon. As one example ¾" MDF may be used for the skeleton.

According to other exemplary embodiments, a cajon includes a striking surface disposed on a first side of the cajon and a mass affixed to a portion of the striking surface to increase the effective mass of the striking surface and to reduce a fundamental frequency of the striking surface. The mass may include a fastener, such as a bolt, passing through the striking surface and one or more weights affixed to the fastener. If desired, multiple fasteners and weights may be used at multiple locations of the striking surface to further modify the fundamental frequency of the striking surface. A solid molecular applied surface, such as a spayed-on polyester primer or polyurethane, is another method for adding mass to the vibratory/resonating surface.

According to other exemplary embodiments, a cajon includes a striking surface disposed on a first side of the cajon, a receptacle contained within the cajon in a manner so as to be at least selectively in contact with an inner side of the striking surface, and a plurality of small metal items loosely contained within the receptacle so as to provide a snare effect when the striking surface is struck, the small metal items comprising a metal selected from the group consisting of copper and silver. The receptacle containing metal items provides a snare effect to the cajon when struck. While the small metal items may be formed of a variety of metals, the use of copper and silver will provide improved tone to the snare effect. The receptacle may be or include a bag formed of a flexible material. The small metal items may be similarly sized and shaped as BB ammunition, for example.

According to other exemplary embodiments, a cajon takes a generally cuboid form and includes a top, a bottom, a first pair of opposed sides extending between the top and the bottom, and a second pair of opposed sides extending between the top and the bottom and further extending between the first pair of opposed sides, wherein internal dimensions between the top and the bottom, between the first pair of opposed sides, and between the second pair of opposed sides are selected based on resonant fundamental frequencies of selected tones from a selected style of music. The various internal dimensions may be selected so the respective resonant fundamental frequencies provide a pleasing tone to the cajon according to principles of the selected style of music. As described herein, one of the four sides of the cajon includes or forms a striking surface, and the internal dimension of the pair of sides including the striking surface is measured from an inner surface of the striking surface. The selected style of music may be a style selected from the group of a traditional twelve-pitch-per-octave western style, a pentatonic style, or some other style, as desired.

According to other exemplary embodiments, a cajon includes a striking surface and a damping material disposed within the cajon to tune the cajon. The damping material may be disposed within the cajon either in contact with a striking surface of the cajon, or it may be disposed within the cajon out of direct contact with the striking surface. The damping material may serve a similar purpose to damping materials used in other drums, such as is commonly used to muffle bass drums.

Embodiments of the invention may provide multiple of the features disclosed herein in a variety of combinations. The scope of the claimed invention is not limited to any particular combination of features discussed herein or shown in the appended figures, but should be ascertained by reference to the appended claims.

FIG. 1 shows a perspective view of a representative cajon 10. The cajon 10 is substantially cuboid in shape, and has a top 12 and a bottom 14. A front side 16 extends between the top 12 and the bottom 14, and a back side 18 also extends between the top 12 and the bottom 14 on a side of the cajon 10 opposed to the front side 16. Two other opposed sides extend between the top 12 and the bottom 14: a left side 20 and a right side 22. While the cajon 10 is illustrated as having sharp edges where the respective sides of the cuboid shape meet, it will be appreciated that the cajon 10 may have rounded edges and corners for aesthetic and functional reasons.

The front side 16 of the cajon 10 forms or includes a striking surface 24. The striking surface 24 is intended to receive blows, such as blows from all or portions of a user's hands. The sound that is thereby produced may depend on the strength of each blow as well as the location of each blow on the striking surface 24. While essentially any location on the cajon 10 may be struck or receive a blow to cause the cajon 10 to produce a desired sound, the striking surface 24 may differ from the other surfaces and sides of the cajon 10 in ways that will cause users to generally favor striking the striking surface 24. One feature of the front side 16 that may modify the sound of the striking surface compared to the other sides of the cajon 10 is the presence of a vent hole 26 or vent port disposed on the front side 16, in this case near the bottom of the front side 16. This location of the vent hole 26 on the front side 16 allows the striking surface 24 and the vent hole 26 of the cajon 10 to act as a classic Helmholtz resonator.

Additionally, the cajon 10 may include other features to modify the striking surface 24 compared to the other sides of the cajon 10. For example, the striking surface 24 may be formed of or include maple wood, such as one or more thin layers of maple wood. Maple is a classic tone wood, and forming the striking surface 24 of maple may improve the tone of the cajon over other materials from which the striking surface 24 could be formed. Each layer of maple may have a thickness of between approximately 1/32" and 1/12." In one embodiment, the striking surface 24 includes two layers of 1/20" maple. In contrast, the other sides of the cajon 10, including the top 12, the bottom 14, the back side 18, the left side 20 and the right side 22 may include or be formed of a substantially rigid material, such as ¾" medium density fiberboard (MDF).

Causing the sides other than the side forming the striking surface 24 to be substantially rigid prevents loss of volume out of the other sides with resulting phase cancellations. If these sides were not rigid, vibrational energy from within the cajon could escape out the sides and could constructively/destructively interfere with the sound coming from the front side 16 of the cajon 10, causing a loss in volume as well as other directional effects due to the constructive/destructive interference of sound waves emanating from the various sides of the cajon 10. Even though the various sides of the cajon 10 may include different materials (e.g. thin maple vs. comparatively thick MDF), an exterior finish may be applied so that the various sides of the cajon 10 substantially match in appearance, as desirable.

Figure 2:
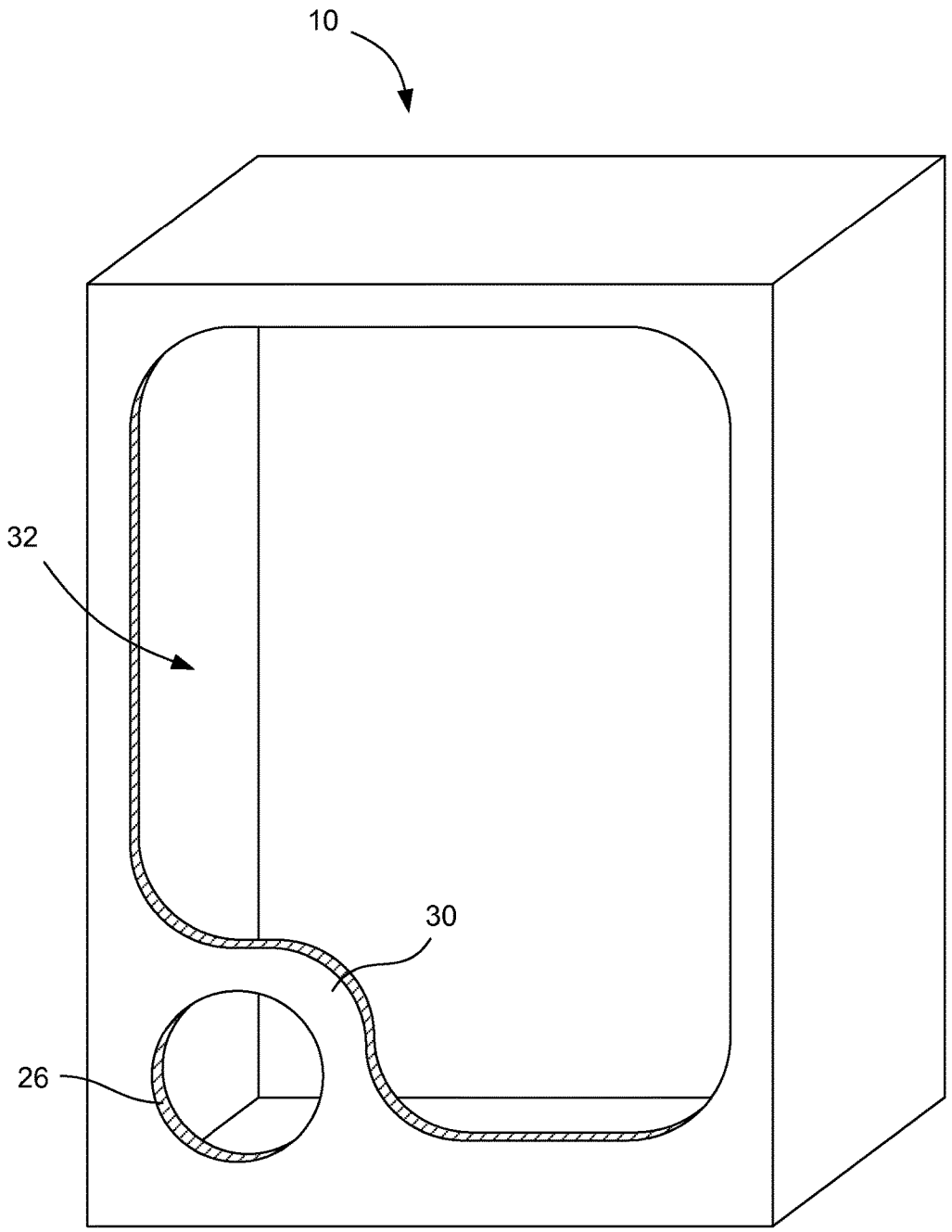
FIG. 2 shows a perspective view of an exemplary cajon where a front sound board has been removed.
Figure 3:
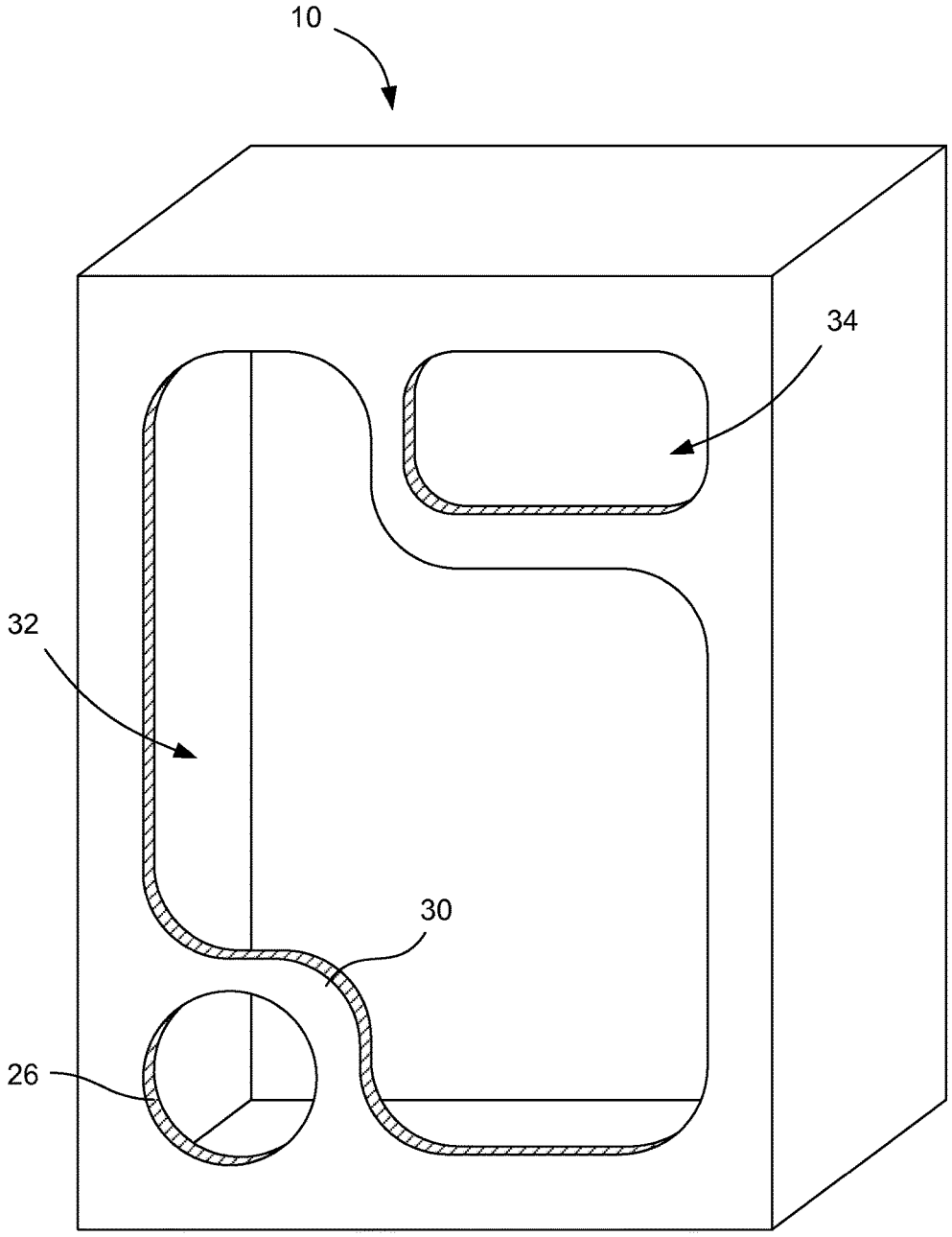
FIG. 3 shows a perspective view of an alternate exemplary cajon where a front sound board has been removed.

While the front side 16 of the cajon 10 includes the striking surface 24 in some embodiments, the front side 16 may also include additional materials other than those forming the striking surface 24. For example, FIGS. 2 and 3 show alternate embodiments of a cajon 10, in which the material of the striking surface 24 (e.g. one or more layers of maple) have been removed to show an underlying skeleton 30. In some embodiments, the skeleton 30 may be formed or include a substantially rigid material that is similar to the material used for the other sides of the cajon 10. In other words, in some embodiments, the skeleton may be formed of or include ¾" MDF. The skeleton 30 may provide additional support for portions of the striking surface 24, and may serve to define other portions of the front side 16, such as the location of the vent hole 26. The material of the striking surface 24 may be affixed to the skeleton 30 at some or all locations where the skeleton 30 underlies the striking surface 24, or in alternate embodiments, the material of the striking surface overlays at least some portions of the skeleton 30 without being affixed thereto. The choice of affixing the material of the striking surface 24 to a particular portion of the skeleton 30 is a matter of experimentation to achieve a desired tone The skeleton 30 may also optionally serve to effectively divide or partition the striking surface 24 into different striking areas having different tones, as is best illustrated in FIG. 3. In the example of FIG. 2, the skeleton 30 defines the vent hole 26 and a single large striking area 32. In contrast, in the example of FIG. 3, the skeleton 30 defines the vent hole 26, a large striking area 32, and a small striking area 34. It should be understood that the specific sizes and shapes of the various striking areas 32, 34 shown in FIGS. 2 and 3 are illustrative only and should not be deemed restrictive of the various sizes and shapes of striking areas that could be defined by the skeleton 30. Additionally, while FIGS. 2 and 3 illustrate one and two striking areas, respectively, skeletons 30 of cajones could define additional striking areas as desired.

When the striking surface 24 is divided into differently sized and/or shaped areas, the user is able to better vary the tone obtained from the cajon 10. In a traditional cajon, the user would be limited in his or her ability to modify the tone of the cajon to striking the cajon nearer or farther from the center of the striking area. In the cajon 10 illustrated in FIG. 3, however, the user can modify the tone in multiple manners. First, the user can still elect whether to strike nearer or farther from the center of any particular striking area. Second, however, the user can vary the tone by selecting which striking area to use: a lower tone can be achieved by striking a larger striking area defined by the skeleton 30 and a higher tone can be achieved by striking a smaller area defined by the skeleton 30. Third, the user can vary the tone by electing to strike a striking area in, for example, a narrowed lobe of the striking area as opposed to a more open portion of the striking area. A lobe may have a different tone than a more open portion. Thus, cajones 10 incorporating a variation of the skeleton 30 may greatly increase the range of sounds or tones available to the user, allowing a single instrument, for example, to produce snare tones, midrange tones, and bass tones.

Other features may be used to further modify the tone or tones provided by the cajon 10. While not specifically illustrated in FIGS. 1-3, a mass may be added to a portion of the striking surface 24 (generally on an interior portion of the striking surface 24) to modify (e.g. lower) the tone of the striking surface 24. The added mass generally lowers the resonant frequency of the striking surface 24 due to the additional mass that must move as the striking surface 24 vibrates. The mass may be added in any desirable manner, but it may be added, for example, by being affixed to an interior surface of the striking surface 24 (e.g. by gluing), or it may be affixed by a fastener that passes through the striking surface 24 (e.g. by a bolt and washers). The tone of the striking surface 24 may be fine-tuned by varying the mass affixed to the striking surface 24 until a desired tone is achieved.

Some users of cajones wish to achieve a snare drum effect, such as by adding springs to the cajones. In embodiments of the invention, a similar effect to a snare drum may be achieved that is an improvement to the efforts provided with existing cajones. A bag or other receptacle may be provided on an interior surface of the cajon 10, specifically on the interior surface of the striking surface 24. The bag or other receptacle may be selectively provided in at least intermittent direct contact with the striking surface 24, such that vibrations of the striking surface 24 are transmitted to the bag or other receptacle. The bag or other receptacle contains small metal items (e.g. BBs) that are caused to vibrate and make noise when the cajon 10 is struck. The sound so made may be improved or modified through careful selection of the number, size, shape, and materials used for the small metal items, as well as through selection of the size, shape, material and form of the bag or other receptacle, and some experimentation may be necessary to achieve a desired result. While selection of the sound so made may be a subjective matter of choice, the use of copper and/or silver metal items may provide an improved musical quality to the sound so produced over the use of other metals. If desired, the receptacle or bag may be placed in one or more of the various striking areas, e.g. in the large striking area 32 and/or the small striking area 34 shown in FIG. 3.

As may be appreciated from FIGS. 1-3, the various sides of the cajon 10 (including the top 12 and the bottom 14) define internal dimensions of the distances between respective opposing sides. In the case of the front side 16 and the back side 18, the internal dimension may be measured from the back of the striking surface 24 (e.g. the back of the maple layer(s)) or other wood layers forming the striking surface 24 to the front (interior surface) of the back side 18. In embodiments of the invention, the cajon 10 is sized so that each of the internal dimensions is chosen to correspond to a resonant fundamental frequency of a selected tone of a selected style of music. By way of example and not limitation, a selected style of music may correspond to a Western style of music (e.g. a traditional twelve-pitch octave) or to a pentatonic style of music, or to some other style of music. The internal dimensions may then be chosen to correspond to fundamental frequencies of tones or notes within the selected style of music (e.g. C, D, and E in a Western style of music). In this fashion, the cajon 10 may resonate at frequencies corresponding to musical notes that may be readily found within the style of music, improving musicality of the cajon 10.

The tone of the cajon 10 may optionally be further modified by the use of a damping material within the cajon 10. The damping material may be used in a similar fashion to such materials when used, for example, in traditional bass drums, and the damping material may be placed within the cajon 10 in an amount and location chosen to achieve a desired modification of the tone of the cajon 10. The exact amount and placement is subject to personal tastes and experimentation, but by way of example, the damping material may be placed so as to be in contact with the back side of the striking surface 24, or it may be placed so as not to be in contact with the back side of the striking surface 24.

The tone of the cajon 10 may optionally be further modified at the time of construction by way of modifying the manner of construction. For example, prior to final assembly, the front panel that forms the striking surface 24, may be soaked in a water or liquid that causes the wood of the front panel to expand. The front panel is next adhered to the skeleton 30 using a polyurethane waterproof glue. The glue cures before the material of the front panel completely dries from the soaking, such that as the material of the front panel dries and attempts to contract, at least a portion of the contraction is prevented by the adherence between the skeleton 30 and the front panel. This places the front panel (the resonating surface) in increased tension/preload tension. The result is a more resonant and vibratory surface or one with a different tone.

A similar construction method may be used on any wooden type resonant instrument with a wooden surface or sound board over a skeleton, frame, or other supporting structure. Such construction may modify and improve the resonating properties of such instruments. By way of example, this method of construction could be used on guitars, violins, violas, cellos, basses, harps, pianos, lutes, and any of a variety of stringed instruments, percussive instruments, etc., regardless of whether each possible instrument that might benefit is specifically listed herein.

It may be appreciated that the choice of the wooden material or materials selected for the front panel may cause differing amounts of water to be absorbed and differing amounts of expansion during soaking and contraction (or attempted contraction) during drying. Additionally, the amount of expansion prior to gluing can be controlled by the amount of time of soaking and by other treatments known in the wood crafting arts. Additionally, various stresses may be set up in the different layers of the front panel by way of the orientation(s) of the various layers, grain choices, or any other choices known in the wood crafting arts. Furthermore, in at least some instances, glue may be added to the water or other liquid used for soaking the front panel so as to aid in rigidity and to further modify the resulting resonance of the soundboard surface.

Figure 4:
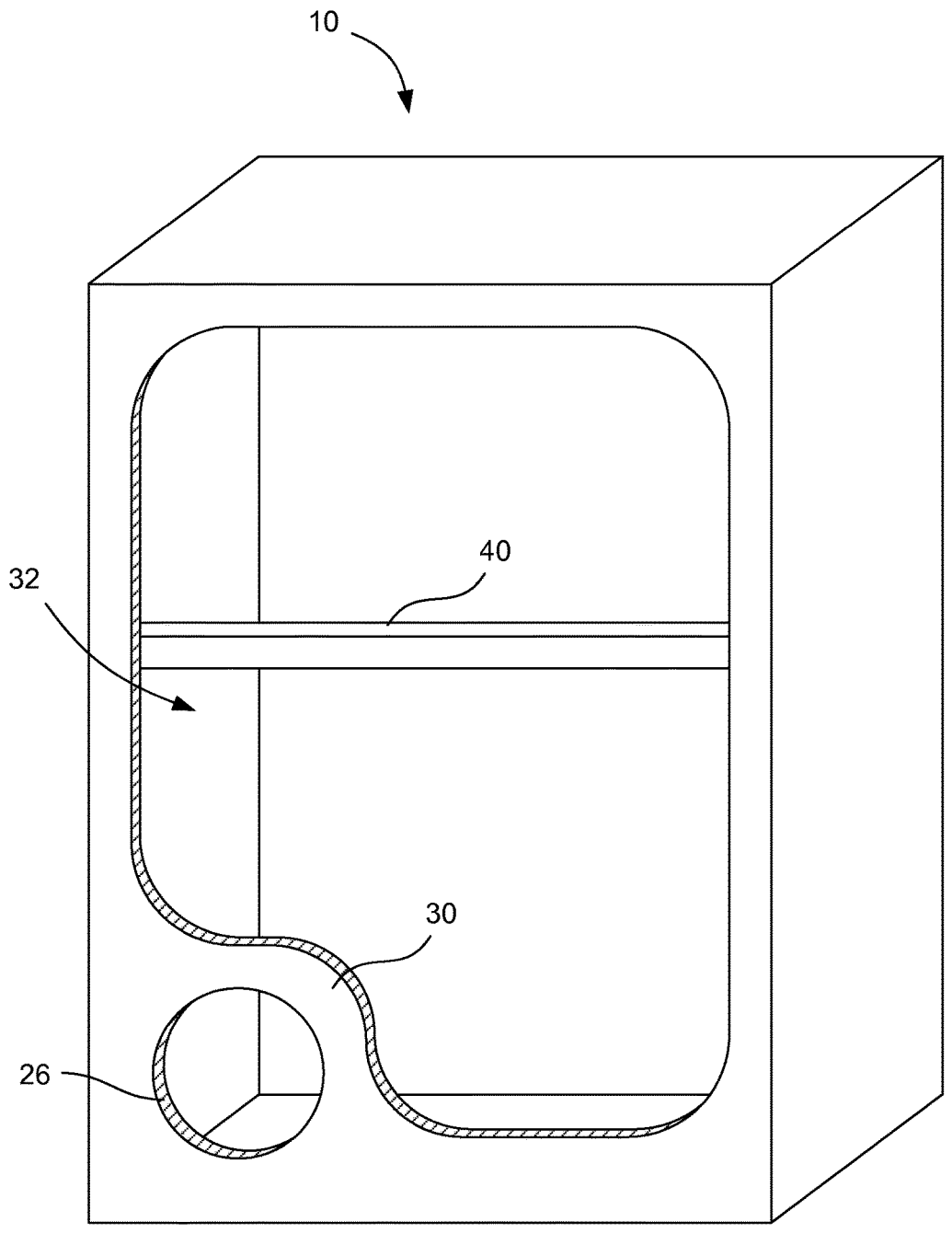
FIG. 4 shows a perspective view of an alternate exemplary cajon where a front sound board has been removed.
Figure 5:
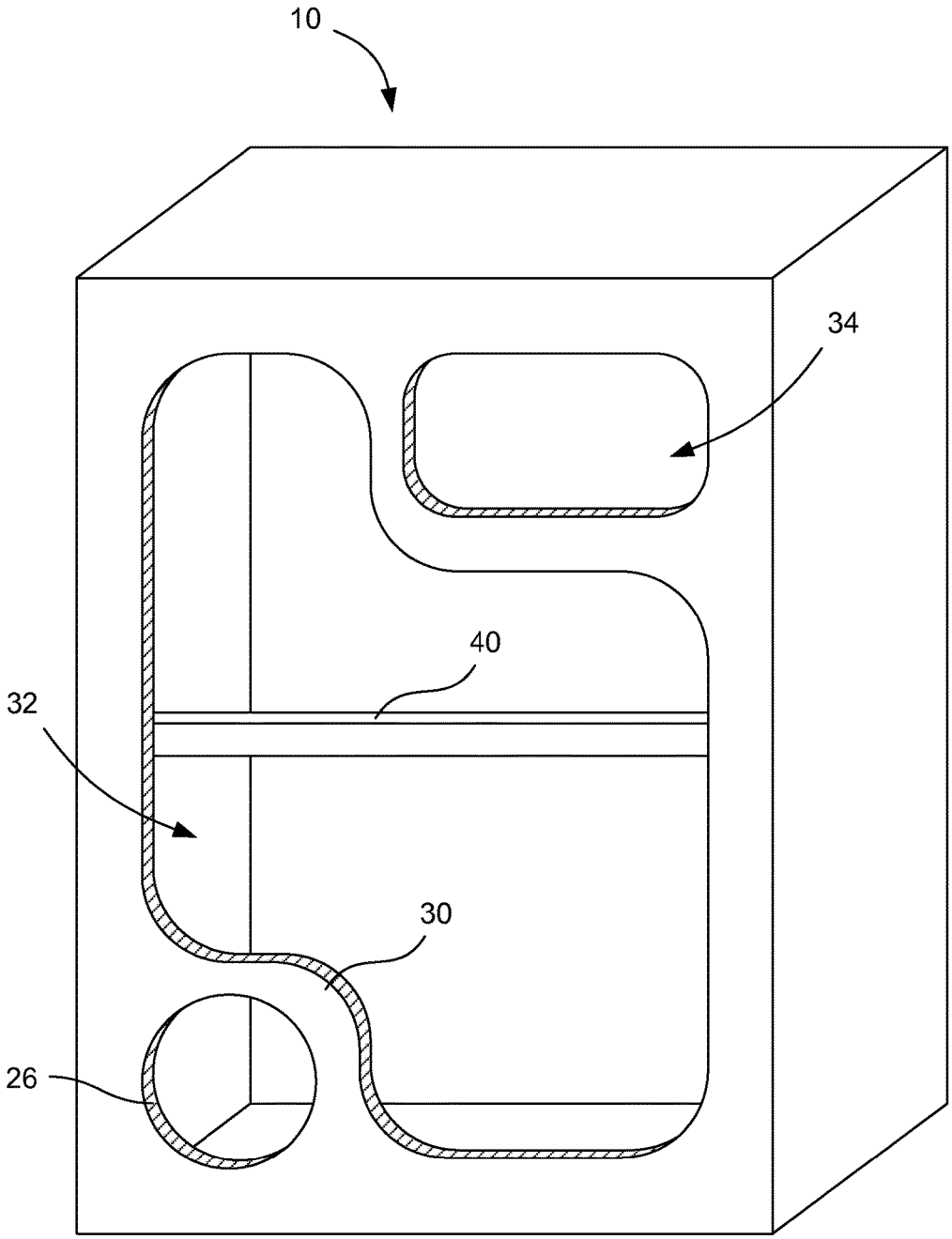
FIG. 5 shows a perspective view of an alternate exemplary cajon where a front sound board has been removed.

FIGS. 4 and 5 illustrate features of additional embodiments of the invention. In these examples, a cross member brace 40 has been added near the front of the cajon 10. The cross member brace 40 is located behind the front panel sufficiently as to avoid contact with the material forming the striking surface 24 regardless of the strength with which the striking surface 24 is struck (within reasonable limits). The cross member brace 40 is intended to provide additional strength to the cajon against deformations or other forces that might otherwise interfere with the function and tone of the cajon 10, but without impacting the tone of the cajon 10 as would occur if the cross member brace 40 contacted or were adhered to the back of the striking surface 24. While in the illustrated embodiments the cross member brace 40 is illustrated as being formed separately from and mounted just behind the skeleton 30, the cross member brace 40 may alternatively be formed from and integrally with the material of the skeleton 30, but with a front portion sanded, carved, or otherwise removed or ablated away to avoid contact with the back of the striking surface 24.

While various embodiments and features have been described herein, embodiments of the invention embrace myriad combinations of the features discussed herein, and the scope of the invention should be determined not by the specific examples discussed herein. The present invention may be embodied in other specific forms without departing from its spirit or essential characteristics. The described embodiments are to be considered in all respects only as illustrative and not restrictive. The scope of the invention is, therefore, indicated by the appended claims, rather than by the foregoing description. All changes which come within the meaning and range of equivalency of the claims are to be embraced within their scope.

What is claimed and desired to be secured by Letters Patent is:

1. A method for constructing a musical instrument of a type having a sound board and an underlying supporting structure, the method comprising:

forming the underlying supporting structure, whereby the underlying supporting structure defines one or more voids to be covered by the sound board and a cross member brace extending across at least one of the one or more voids;

forming the sound board from a wood material into a desired shape and size;

soaking the sound board in an aqueous medium until the sound board has absorbed a desired amount of water and has expanded a desired amount thereby;

affixing the soaked sound board to the underlying support structure using a waterproof adhesive before the soaked sound board has dried, whereby the soaked sound board covers the one or more voids in the underlying supporting structure but is removed from, does not contact, and is not affixed to at least a portion of the cross member brace; and drying the soaked sound board after the adhesive has cured, establishing tension in the sound board across the one or more voids in the underlying supporting structure.

2. A method as recited in claim 1, wherein the sound board is a striking surface of a cajon and the underlying support structure is a skeleton of the cajon.

3. A method as recited in claim 2, wherein the aqueous medium comprises a mixture of water and glue.

4. An instrument comprising a sound board attached to an underlying support structure according to the method as recited in claim 1.

5. An instrument as recited in claim 4, wherein the instrument is selected from the group consisting of:

a cajon;
a guitar;
a violin;
a viola;
a cello;
a string bass;
a harp;
a piano; and
a lute.

6. An instrument as recited in claim 4, wherein the instrument is a cajon.

7. A method as recited in claim 1, wherein the waterproof adhesive comprises a polyurethane waterproof glue.

8. A method as recited in claim 1, wherein the aqueous medium used to soak the sound board does not comprise an adhesive.

9. A method for constructing a musical instrument of a type having a sound board and an underlying supporting structure, the method comprising:

forming the underlying supporting structure, whereby the underlying supporting structure defines one or more voids to be covered by the sound board and a cross member brace extending across at least one of the one or more voids;

forming the sound board from a wood material into a desired shape and size;

soaking the sound board in water until the sound board has absorbed a desired amount of water and has expanded a desired amount thereby;

affixing the soaked sound board to the underlying support structure using a waterproof adhesive before the soaked sound board has dried, whereby the soaked sound board covers the one or more voids in the underlying supporting structure but is removed from, does not contact, and is not affixed to at least a portion of the cross member brace; and drying the soaked sound board after the adhesive has cured and establishing tension in the sound board across the one or more voids in the underlying supporting structure by drying the sound board.

10. A method as recited in claim 9, wherein the sound board is a striking surface of a cajon and the underlying support structure is a skeleton of the cajon.

11. A method as recited in claim 9, wherein the aqueous medium comprises a mixture of water and glue.

12. An instrument comprising a sound board attached to an underlying support structure according to the method as recited in claim 9.

13. An instrument as recited in claim 12, wherein the instrument is selected from the group consisting of:

a cajon;
a guitar;
a violin;
a viola;
a cello;
a string bass;
a harp;
a piano; and
a lute.

14. An instrument as recited in claim 12, wherein the instrument is a cajon.

15. A method for constructing a musical instrument of a type having a sound board and an underlying support structure, the method comprising:

forming a skeleton defining an exterior edge of a panel of the musical instrument and a sound-board-contacting surface of the skeleton, and further defining one or more openings to be covered by the sound board;

forming a cross member brace extending across at least one of the one or more openings;

forming the sound board from a wood material into a desired shape and size conforming to the exterior edge of the panel of the musical instrument;

soaking the sound board in an aqueous medium until the sound board has absorbed a desired amount of liquid and has expanded a desired amount thereby;

affixing the soaked sound board to the skeleton using a waterproof adhesive before the soaked sound board has dried, whereby the soaked sound board covers the one or more openings defined by the skeleton but is removed from, does not contact, and is not affixed to at least a portion of the cross member brace; and drying the soaked sound board after the adhesive has cured and establishing tension in the sound board across the one or more openings defined by the skeleton by drying the sound board.

16. A method as recited in claim 15, wherein the skeleton is formed to define a cross member brace extending across at least one of the one or more openings, the method further comprising removing material from a side of the cross member brace proximate the sound board such that when the sound board is affixed to the skeleton, the sound board does not contact the cross member brace.

17. A method as recited in claim 15, wherein resonant properties of the sound board after drying are controlled by one or more of selecting one or more wood materials for the sound board, varying the amount of soaking of the sound board prior to affixation of the sound board to the skeleton, controlling the amount of expansion during soaking by pretreating the sound board prior to soaking, orienting one or more layers of the sound board relative to the skeleton or other layers of the sound board, and adding glue to the aqueous medium used for soaking the sound board.

18. A method as recited in claim 15, wherein the sound board is a striking surface of a cajon.

19. A method as recited in claim 15, wherein the aqueous medium comprises a mixture of water and glue.

* * * * *